US005516381A

United States Patent [19]

Kawai et al.

[11] Patent Number: 5,516,381

[45] **Date of Patent: *May 14, 1996**

[54] ROTATING BLADE OR STATIONARY VANE OF A GAS TURBINE

[75] Inventors: Hisataka Kawai; Ikuo Okada; Ichiro Tsuji; Koji Takahashi, all of Takasago; Kensho Sahira; Akira Mitsuhashi, both of Omiya, all of Japan

[73] Assignees: Mitsubishi Materials Corporation; Mitsubishi Jukogyo Kabushiki Kaisha, Tokyo, Japan

[ * ] Notice: The term of this patent shall not extend beyond the expiration date of Pat. No. 5,431,750.

[21] Appl. No.: 377,925

[22] Filed: Jan. 25, 1995

Related U.S. Application Data

[62] Division of Ser. No. 901,241, Jun. 19, 1992, Pat. No. 5,431,750.

[30] Foreign Application Priority Data

Jun. 27, 1991 [JP] Japan ..... 3-183056

[51] Int. Cl.[6] ..... C22C 19/05

[52] U.S. Cl. ..... 148/410; 420/443; 420/444; 420/448; 416/241 R

[58] Field of Search ..... 420/443, 444, 420/448; 416/241 R; 148/410

[56] References Cited

U.S. PATENT DOCUMENTS

| | | | |
|---|---|---|---|
| 3,459,545 | 8/1969 | Bieber et al. | 420/448 |
| 3,765,879 | 10/1973 | Hockin et al. | 420/448 |
| 4,719,080 | 1/1988 | Duhl et al. | 420/443 |
| 5,055,147 | 10/1991 | Henry | 420/443 |
| 5,077,141 | 12/1991 | Naik et al. | 428/680 |

FOREIGN PATENT DOCUMENTS

| | | |
|---|---|---|
| 705385 | 3/1965 | Canada . |
| 0361084 | 4/1990 | European Pat. Off. . |
| 0381828 | 8/1990 | European Pat. Off. . |
| 0413439 | 2/1991 | European Pat. Off. . |
| 220845 | 4/1985 | German Dem. Rep. . |
| 1-59344 | 12/1989 | Japan . |
| 1511562 | 5/1978 | United Kingdom . |

*Primary Examiner*—George Wyszomierski
*Attorney, Agent, or Firm*—Frishauf, Holtz, Goodman, Langer & Chick

[57] ABSTRACT

A rotating blade or stationary vane of a gas turbine which is made of a nickel alloy containing Cr, Co, Mo, W, Ta, Al, Ti, C, B, Zr, and one or both of Mg and Ca. Additionally, the alloy may contain Hf, Pt, Rh and Re.

15 Claims, No Drawings

ROTATING BLADE OR STATIONARY VANE OF A GAS TURBINE

This is a division of application Ser. No. 07/901,241 filed Jun. 19, 1992 now U.S. Pat. No. 5,431,750.

BACKGROUND OF THE INVENTION

This invention relates to castable Ni-base heat-resistant alloys suitable for use as materials that form the rotating blades and stationary vanes of a gas turbine, and other machine parts that are to be subjected to elevated temperatures.

Nickel-base heat-resistant alloys that are predominantly used as constituent materials for producing the rotating blades and stationary vanes of a gas turbine, the moving vanes of a hot blower and other machine parts that are to be subjected to elevated temperatures are those which are both precipitation hardened with the γ' phase {$Ni_3$(Al, Ti)} and solid-solution hardened with Mo, W, etc. See, for example, Japanese Patent Publication No. 59344/1989 which describes a Ni-base heat-resistant alloy that has high strength and high resistance to oxidation and corrosion at elevated temperatures and which consists, by weight percent (all percentages that follow are on a weight basis), of 7–13% Cr, no more than 35% Co, no more than 8% Mo, no more than 3% Nb, no more than 14% W, no more than 6% Ta, 4–7% Al, 0.5–6% Ti (provided Al+Ti=6.5–10.5%), no more than 1.5% V, no more than 0.2% Zr, 0.7–5% Hf, 0.02–0.5% C and 0.002–0.2% B, with the remainder being Ni and incidental impurities. If the addition of Mo, W, etc. to those alloys is excessive, deleterious phases such as the α and μ phases will develop and, hence, Al and Ti are added in large amounts so that more of the γ phase will develop to give higher strength at elevated temperatures.

In such predominant Ni-base heat-resistant alloys, Mo and W are added in large amounts to an extent that will not cause the formation of any deleterious phases in the alloy structure and this inevitably limits the Cr content to 7–13%. Under the circumstances, the high-temperature strength of the alloys is improved but, on the other hand, their resistance to oxidation and corrosion at elevated temperatures is so much reduced that the alloys can only be used as constituent materials for fabricating gas turbines of a type that operates on high-grade fuels which emit smaller amounts of oxidizing and corrosive materials upon combustion. It has therefore been required to develop Ni-base heat-resistant alloys that can be used as constituent materials for fabricating gas turbines of a type that can produce a higher output power even if they are operated on low-grade fuels.

SUMMARY OF THE INVENTION

The present inventors conducted intensive studies in order to meet that requirement and, as a result, they found that the high-temperature strength of Ni-base heat-resistant alloys could be improved without compromising their resistance to oxidation and corrosion at elevated temperatures when the Cr content was adjusted to a slightly higher level of 13.1–15% with W, Mo, Al, Ti, Ta, C, B, Zr and other elements being added in such amounts as to attain the best possible balance and when the adverse effects of impurities such as oxygen and sulfur were suppressed by adding Mg and/or Ca in a total amount of 1–100 ppm. It was also found that Ni-base alloys with such balanced properties could be used as a constituent material for fabricating not only gas turbines that operate on high-grade fuels but also those which operate on low-grade fuels such as heavy oils. The present invention has been accomplished on the basis of these findings.

The Ni-base heat-resistant alloy of the present invention has high strength and high resistance to oxidation and corrosion at elevated temperatures and consists of 13.1–15.0% Cr, 8.5–10.5% Co, 1.0–3.5% Mo, 3.5–4.5% W, 3.0–5.5% Ta, 3.5–4.5% Al, 2.2–3.2% Ti, 0.06–0.12% C, 0.005–0.025% B, 0.010–0.050% Zr and 1–100 ppm of Mg and/or Ca, in the optional presence of 0–1.5% Hf and/or 0–0.5% of at least one element selected from among Pt, Rh and Re, with the remainder being Ni and incidental impurities.

DETAILED DESCRIPTION OF THE INVENTION

The criticality of the respective elements to be contained in the Ni-base heat-resistant alloy of the present invention is described below.

Cr: 13.1–15.0%

Gas turbines for industrial applications are required to have high resistance to oxidation and corrosion at elevated temperatures since they are exposed during operation to combustion gases that contain oxidizing and corrosive materials. Chromium is an element that imparts oxidation and corrosion resistance to the alloy of the present invention and its effectiveness becomes more significant as its content in the alloy increases. If the Cr content is less than 13.1%, it will not exhibit its intended effect. On the other hand, the Ni-base alloy of the present invention also contains Co, Mo, W, Ta, etc., so in order to attain balance with these elements, Cr should not be added in amounts exceeding 15%. Hence, the Cr content of the Ni-base alloy of the present invention is specified to lie within the range of 13.1–15.0%, preferably 13.7–14.3%.

Co: 8.5–10.5%

With Ni-base alloys of a type that can be hardened by precipitation of the γ' phase due to the addition of Ti and Al, the mentioned elements are thoroughly dissolved in the matrix by a solid-solution treatment and, in the subsequent aging treatment, those elements are precipitated uniformly and finely, thereby forming the γ' phase which contributes better strength at elevated temperature.

Cobalt is effective in improving the strength of the Ni-base alloy by enhancing the solubility limit, or the limit to which Ti and Al exhibiting the effects described above can be dissolved In the matrix at elevated temperatures. Assuming the Al and Ti contents specified for the alloy of the present invention, Co must be present in an amount of at least 8.5%. If the Co content exceeds 10.5%, the balance with other elements such as Cr, Mo, W, Ta, Al and Ti is upset, causing lower ductility due to the precipitation of deleterious phases. Hence, the Co content of the Ni-base alloy of the present invention is specified to lie within the range of 8.5–10.5%, preferably 9.5–10.5%.

Ti: 2.2–3.2%

Titanium is the element necessary for precipitation of the γ' phase in order to enhance the high-temperature strength of the precipitation-hardenable Ni-base alloy of the present invention. If the Ti content is less than 2.2%, the precipitation hardening by the γ' phase is insufficient to attain the required strength. If the Ti content exceeds 3.2%, precipitation of the γ' phase is so substantial as to impair the ductility of the alloy. Hence, the Ti content of the Ni-base alloy of the present invention is specified to lie within the range of 2.2–3.2%, preferably 2.5–2.9%.

Al: 3.5–4.5%

Aluminum is an element that exhibits the same effect as Ti; it contributes to the formation of the γ' phase, thereby enhancing the high-temperature strength of the alloy. In addition, Al helps impart oxidation and corrosion resistance to the alloy at elevated temperatures. For achieving the intended effects, Al must be contained in an amount of at least 3.5%. If the Al content exceeds 4.5%, the ductility of the alloy is impaired. Hence, the Al content of the Ni-base alloy of the present invention is specified to lie within the range of 3.5–4.5%, preferably 3.8–4.2%.

Mo: 1.0–3.5%

Molybdenum will dissolve in the matrix to enhance the high-temperature strength of the alloy. In addition, Mo also contributes high-temperature strength through precipitation hardening. If the Mo content is less than 1.0%, its intended effects will not be attained. If the Mo content exceeds 3.5%, a deleterious phase will be precipitated to impair the ductility of the alloy. Hence, the Mo content of the Ni-base alloy of the present invention is specified to lie within the range of 1.0–3.5%, preferably 1.3–1.7%.

W: 3.5–4.5%

Tungsten is the same as Mo in that it has a dual capability for solid-solution hardening and precipitation hardening, contributing to the high-temperature strength of the alloy. To achieve its intended effects, W must be contained in an amount of at least 3.5%. If the W content is excessive, a deleterious phase will be precipitated and, at the same time, the specific gravity of the alloy will increase because tungsten itself is an element of high specific gravity and this is not only unfavorable for the purpose of using the alloy as a constituent material for fabricating the moving vanes of a turbine that will produce a centrifugal force upon rotation but also disadvantageous from an economic viewpoint. Hence, the W content of the Ni-base alloy of the present invention is specified to lie within the range of 3.5–4.5% preferably 4.1–4.5%.

Ta: 3.0–5.5%

Tantalum contributes to an improvement in the high-temperature strength of the alloy through solid-solution hardening and γ' phase precipitation hardening. The effects of Ta will be exhibited if it is contained in an amount of at least 3.0%. If its addition is excessive, the ductility of the alloy will be impaired and, hence, the upper limit of the Ta content of the Ni-base alloy of the present invention is specified to be 5.5%, preferably 4.5–4.9%.

C: 0.06–0.12%

Carbon will form carbides that are precipitated preferentially at grain boundaries and dendrite boundaries to strengthen these boundaries, thereby contributing to an improvement in the high-temperature strength of the alloy. To achieve its intended effects, carbon must be contained in an amount of at least 0.06%. However, if the C content exceeds 0.12%, the ductility of the alloy will be impaired. Hence, the C content of the Ni-base alloy of the present invention is specified to lie within the range of 0.06–0.12%.

B: 0.005–0.025%

Boron enhances the binding force at grain boundaries, thereby strengthening the matrix of the alloy to increase its high-temperature strength. To achieve its intended effects, boron must be contained in an amount of at least 0.005%. On the other hand, excessive addition of B can potentially impair the ductility of the alloy. Hence, the upper limit of the B content of the Ni-base alloy of the present invention is specified to be 0.025%.

Zr: 0.010–0.050%

Zirconium also enhances the binding force at grain boundaries, thereby strengthening the matrix of the alloy to increase its high-temperature strength. To achieve its intended effects, zirconium must be contained in an amount of at least 0.010%. On the other hand, excessive addition of Zr can potentially impair the ductility of the alloy. Hence, the upper limit of the Zr content of the Ni-base alloy of the present invention is specified to be 0.050%.

Mg and/or Ca: 1–100 ppm

Magnesium and/or calcium has a strong affinity with impurities such as oxygen and sulfur and they are also capable of preventing the decrease in ductility due to those impurities. If the content of Mg and/or Ca is less than 1 ppm, their intended effects will not be achieved. If, their content exceeds 100 ppm, the binding between grain boundaries will be attenuated rather than strengthened to eventually cause cracking. Hence, the content of Mg and/or Ca in the N1-base alloy of the present Invention is specified to lie within the range of 1–100 ppm.

Hf: 0–1.5%

Hafnium is capable of strengthening grain boundaries when columnar crystals are produced by unidirectional solidification. If hafnium is contained in an amount exceeding 1.5% it will bind with oxygen to form an oxide in the alloy, potentially causlng cracks. Hence, the hafnlum content of the Nl-base alloy of the present invention is specified to lie within the range of 0–1.5%.

At Least One Element of Pt, Rh and Re: 0–0.5%

These elements are effective in improving the corrosion resistance of the alloy. Even if their content exceeds 0.5%, no further improvement will be achieved. In addition, these elements are precious metals and using them in more than necessary amounts is not preferred from an economic viewpoint. Hence, the content of at least one of Pt, Rh and Re in the Ni-base alloy of the present invention is specified to lie within the range of 0–0.5%.

While the preferred ranges of the contents of Cr, Co, Mo, W, Ta, Al and Ti have been specified above with respect to the Ni-base heat-resistant alloy of the present invention, it should be noted that those elements will contribute to an improvement of the relative rupture life of the alloy if their combination and contents are properly selected.

The Ni-base heat-resistant alloy of the present invention is described below in greater detail with reference to working examples.

EXAMPLES

Nickel-base heat-resistant alloys having the compositions shown in Tables 1–3 were vacuum melted and the resulting melts were cast into a mold to make round bars having a diameter of 30 mm and a length of 150 mm. The bars were subjected to a solid-solution treatment by soaking at 1160° C. for 2 h and then to an aging treatment by soaking at 843° C. for 24 h, whereby samples of the Ni-base heat-resistant alloy of the present invention (Run Nos. 1–24), comparative samples (Run Nos. 1–4) and prior art samples (Run Nos. 1 and 2) were prepared. Prior art sample No. 1 was an equivalent of the alloy described in Japanese Patent Publication No. 59344/1989, supra and prior art sample Run No. 2 was an equivalent of commercially available Inconel (trademark) 738 as described in U.S. Pat. No. 3,459,545.

TABLE 1

| | Ni-base heat-resistant alloys of the invention | | | | | | | |
|---|---|---|---|---|---|---|---|---|
| Element | 1 | 2 | 3 | 4 | 5 | 6 | 7 | 8 |
| Cr | 13.1 | 14.0 | 15.0 | 13.5 | 14.5 | 13.3 | 14.2 | 13.8 |
| Co | 9.0 | 8.5 | 10.1 | 10.5 | 9.7 | 8.8 | 9.3 | 9.5 |
| Mo | 2.1 | 1.0 | 3.5 | 1.5 | 2.4 | 2.7 | 3.0 | 1.8 |
| W | 4.0 | 3.5 | 4.3 | 3.7 | 4.5 | 4.1 | 3.9 | 4.2 |
| Ta | 3.3 | 5.4 | 4.9 | 3.0 | 3.8 | 3.5 | 3.8 | 4.5 |
| Al | 4.0 | 3.5 | 4.3 | 3.7 | 4.5 | 4.1 | 3.9 | 4.2 |
| Ti | 2.7 | 2.3 | 3.2 | 2.5 | 2.9 | 3.0 | 2.8 | 2.7 |
| C | 0.08 | 0.10 | 0.06 | 0.12 | 0.07 | 0.09 | 0.11 | 0.08 |
| B | 0.011 | 0.009 | 0.007 | 0.015 | 0.013 | 0.012 | 0.010 | 0.005 |
| Zr | 0.030 | 0.050 | 0.041 | 0.034 | 0.047 | 0.038 | 0.045 | 0.039 |
| Ca | 54 | — | 5 | 25 | 74 | 34 | 10 | 18 |
| Mg | 22 | 98 | — | 37 | 5 | 54 | 12 | 72 |
| Hf | — | — | 1.1 | 0.7 | 1.2 | 0.9 | 0.8 | — |
| Pt | — | — | — | — | 0.5 | — | — | 0.05 |
| Rh | — | — | — | — | — | 0.3 | — | |
| Re | — | — | — | — | — | — | 0.4 | 0.05 |
| Ni | bal. | bal. | bal. | bal. | bal. | bal. | bal. | bal. |

All numerals refer to percent by weight, except for Ca and Mg whose contents are indicated in ppm.

TABLE 2

| | Ni-base heat-resistant alloys of the invention | | | | | | | |
|---|---|---|---|---|---|---|---|---|
| Element | 9 | 10 | 11 | 12 | 13 | 14 | 15 | 16 |
| Cr | 13.1 | 14.0 | 15.0 | 13.5 | 14.5 | 13.3 | 14.2 | 13.8 |
| Co | 9.0 | 8.5 | 10.1 | 10.5 | 9.7 | 8.8 | 9.3 | 9.5 |
| Mo | 2.1 | 1.0 | 3.5 | 1.5 | 2.4 | 2.7 | 3.0 | 1.8 |
| W | 4.0 | 3.5 | 4.3 | 3.7 | 4.5 | 4.1 | 3.9 | 4.2 |
| Ta | 3.3 | 5.3 | 4.9 | 3.0 | 3.8 | 3.5 | 3.8 | 4.5 |
| Al | 4.0 | 3.5 | 4.3 | 3.7 | 4.5 | 4.1 | 3.9 | 4.2 |
| Ti | 2.7 | 2.3 | 3.2 | 2.5 | 2.9 | 3.0 | 2.8 | 2.7 |
| C | 0.08 | 0.10 | 0.06 | 0.12 | 0.07 | 0.09 | 0.11 | 0.08 |
| B | 0.011 | 0.009 | 0.007 | 0.015 | 0.013 | 0.012 | 0.010 | 0.005 |
| Zr | 0.030 | 0.050 | 0.041 | 0.034 | 0.047 | 0.038 | 0.045 | 0.039 |
| Ca | 54 | — | 99 | 25 | 74 | 34 | 10 | 18 |
| Mg | 22 | 98 | — | 37 | 5 | 54 | 12 | 72 |
| Hf | — | — | 1.5 | 0.7 | 1.2 | 0.9 | 0.8 | 1.3 |
| Pt | 0.05 | 0.1 | — | 0.2 | 0.06 | 0.2 | 0.05 | 0.08 |
| Rh | 0.05 | 0.2 | 0.1 | 0.1 | — | — | 0.09 | — |
| Re | 0.05 | — | 0.3 | — | 0.07 | 0.1 | 0.05 | 0.2 |
| Ni | bal. | bal. | bal. | bal. | bal. | bal. | bal. | bal. |
| Element | 17 | 18 | 19 | 20 | 21 | 22 | 23 | 24 |
| Cr | 14.1 | 13.8 | 13.9 | 14.2 | 14.1 | 13.9 | 14.0 | 14.0 |
| Co | 9.9 | 10.2 | 10.3 | 9.6 | 9.8 | 9.9 | 9.9 | 10.0 |
| Mo | 1.5 | 1.6 | 1.6 | 1.4 | 1.4 | 1.5 | 1.5 | 1.5 |
| W | 4.3 | 4.4 | 4.3 | 4.1 | 4.4 | 4.5 | 4.3 | 4.3 |
| Ta | 4.6 | 4.8 | 4.8 | 4.6 | 4.7 | 4.6 | 4.7 | 4.7 |
| Al | 4.1 | 4.1 | 4.0 | 3.9 | 3.9 | 4.1 | 4.0 | 4.0 |
| Ti | 2.8 | 2.6 | 2.7 | 2.7 | 2.8 | 2.6 | 2.6 | 2.7 |
| C | 0.08 | 0.09 | 0.08 | 0.10 | 0.07 | 0.06 | 0.09 | 0.09 |
| B | 0.014 | 0.011 | 0.009 | 0.013 | 0.012 | 0.025 | 0.019 | 0.015 |
| Zr | 0.037 | 0.022 | 0.013 | 0.023 | 0.021 | 0.039 | 0.030 | 0.02 |
| Ca | — | 12 | — | 28 | 37 | 18 | 10 | — |
| Mg | 31 | 5 | 80 | 29 | 51 | 50 | 14 | 10 |
| Hf | — | — | 0.3 | 0.2 | 0.2 | — | 0.4 | — |
| Pt | — | — | — | — | 0.1 | — | 0.02 | — |
| Rh | — | — | — | — | 0.1 | — | 0.02 | — |
| Re | — | — | — | — | 0.1 | — | 0.2 | — |
| Ni | bal. | bal. | bal. | bal. | bal. | bal. | bal. | bal. |

All numerals refer to percent by weight, except for Ca and Mg whose contents are indicated in ppm.

TABLE 3

| Element | Comparative Ni-base heat-resistant alloys 1 | 2 | 3 | 4 | Prior art Ni-base heat-resistant alloys 1 | 2 |
|---|---|---|---|---|---|---|
| Cr | *12.5 | *15.5 | 14.0 | 13.5 | 9.0 | 16.1 |
| Co | 9.0 | 8.5 | 10.1 | 10.5 | 9.5 | 9.8 |
| Mo | 2.1 | 1.0 | 3.5 | 1.5 | 1.8 | 1.9 |
| W | 4.0 | 3.5 | 4.3 | 3.7 | 10.0 | 2.5 |
| Ta | 3.3 | 5.3 | 4.9 | 3.0 | 1.5 | 1.2 |
| Al | 4.0 | 3.5 | 4.3 | 3.7 | 5.5 | 4.0 |
| Ti | 2.7 | 2.3 | 3.2 | 2.5 | 2.7 | 3.1 |
| C | 0.08 | 0.10 | 0.06 | 0.12 | 0.08 | 0.19 |
| B | 0.011 | 0.009 | 0.007 | 0.015 | 0.015 | 0.020 |
| Zr | 0.030 | 0.050 | 0.041 | 0.034 | 0.05 | 0.100 |
| Ca | 54 | — | *105 | 25 | — | — |
| Mg | 22 | 98 | — | *110 | — | — |
| Nb | — | — | — | — | 1.0 | 1.0 |
| Hf | 1.1 | 0.5 | 1.5 | 0.7 | 1.3 | — |
| Pt | 0.05 | — | — | — | — | — |
| Rh | 0.05 | 0.5 | — | 0.07 | — | — |
| Re | — | — | 0.3 | — | — | — |
| Ni | bal. | bal. | bal. | bal. | bal. | bal. |

All numerals refer to percent by weight, except for Ca and Mg whose contents are indicated in ppm.
The values with an asterisk are outside the scope of the invention.

All samples of Ni-base heat-resistant alloy were subjected to a high-temperature corrosion resistance test and a high-temperature creep rupture strength test by the following procedures and the results of the respective tests are shown in Tables 3–5.

High-temperature corrosion resistance test

Each sample that was in the form of a round bar having a diameter of 30 mm and a length of 150 mm was worked into a test piece measuring 10 mm in diameter by 100 mm in length. The test piece was held for 1 h in the flame of natural gas at a temperature of ca. 1100° C. that contained hydrogen sulfide gas and subjected to 50 cycles of cooling each lasting for 30 min. After these treatments, the scale deposited on the surface of each test piece was removed and its weight loss was measured. The high-temperature corrosion resistance of the samples was evaluated in terms of the weight loss relative to the value for the test piece of prior art sample Run No. 1.

High-temperature creep rupture strength test

Each sample in a round bar form was worked into a test piece measuring 6 mm in diameter by 25 mm in length in the area bounded by parallel sides. All of the thus prepared test pieces were held in an air atmosphere at a temperature of 871° C. under a load of 35 kg/mm$^2$ and their life to rupture (in hours) was measured. The high-temperature creep rupture strength of the samples was evaluated in terms of the relative life to rupture, with the value for prior art sample Run No. 1 being taken as unity.

TABLE 4

| Run No. | | Relative weight loss | Relative rupture life |
|---|---|---|---|
| Ni-base heat-resistant alloys of the invention | 1 | 0.58 | 1.6 |
| | 2 | 0.51 | 1.1 |
| | 3 | 0.41 | 1.4 |
| | 4 | 0.54 | 1.3 |
| | 5 | 0.42 | 1.6 |

TABLE 4-continued

| Run No. | | Relative weight loss | Relative rupture life |
|---|---|---|---|
| | 6 | 0.40 | 1.5 |
| | 7 | 0.40 | 1.3 |
| | 8 | 0.45 | 1.3 |
| | 9 | 0.42 | 1.5 |
| | 10 | 0.43 | 1.2 |
| | 11 | 0.38 | 1.4 |
| | 12 | 0.44 | 1.3 |

TABLE 5

| Run No. | | Relative weight loss | Relative rupture life |
|---|---|---|---|
| Ni-base heat-resistant alloys of the invention | 13 | 0.39 | 1.6 |
| | 14 | 0.47 | 1.5 |
| | 15 | 0.44 | 1.2 |
| | 16 | 0.48 | 1.3 |
| | 17 | 0.41 | 1.8 |
| | 18 | 0.43 | 1.8 |
| | 19 | 0.40 | 1.7 |
| | 20 | 0.43 | 1.7 |
| | 21 | 0.35 | 1.7 |
| | 22 | 0.40 | 1.8 |
| | 23 | 0.38 | 1.7 |
| | 24 | 0.43 | 1.8 |
| Comparative Ni-base heat-resistant alloys | 1 | 1.08 | 0.4 |
| | 2 | 0.14 | 0.7 |
| | 3 | 0.14 | 0.7 |
| | 4 | 0.48 | 0.8 |
| Prior art Ni-base heat-resistant alloys | 1 | 1 | 1 |
| | 2 | 0.54 | 0.4 |

As one can see from the data shown in Tables 1–5, the alloy compositions of the present invention which had the Cr content adjusted to the range of 13.1–15.0% with W, Mo, Al, Ti, Ta, C, B, Zr and other elements being added in such amounts as to attain the best possible balance and which further contained Mg and/or Ca in a total amount of 1–100 ppm, in the optional presence of Hf and/or at least one of Pt, Rh and Re exhibited high corrosion resistance and creep rupture strength at elevated temperatures.

It can therefore be concluded that the Ni-base alloy of the present invention which is improved not only in high-temperature strength but also in resistance to oxidation and corrosion at elevated temperatures is particularly useful as a constituent material for the moving and stationary vanes of a gas turbine that is to contact combustion gases that contain oxidizing materials, or for the moving vanes of a hot blower, or for other machine parts that are to be exposed to elevated temperatures.

What is claimed is:

1. In a rotating blade or stationary vane of a gas turbine, wherein the improvement comprises the rotating blade or stationary vane being made of a nickel alloy that has high strength and high resistance to oxidation and corrosion at elevated temperatures and that consists essentially of 13.1–15.0% Cr, 8.5–10.5% Co, 1.0–3.5% Mo, 3.5–4.5% W, 3.0–5.5% Ta, 3.5–4.5% Al, 2.2–3.2% Ti, 0.06–0.12% C, 0.005–0.025% B, 0.010–0.05% Zr, 1–100 ppm of Mg and/or Ca, 0–1.5% Hf and 0–0.5% of at least one element selected from the group consisting of Pt, Rh and Re, with the remainder being Ni and incidental impurities, all percentages being on a weight basis, wherein said Ta contributes to an improvement in the high temperature strength of the nickel alloy through $\gamma'$ phase precipitation.

2. In a rotating blade or stationary vane of a gas turbine, wherein the improvement comprises the rotating blade or stationary vane being made of a nickel alloy that has high strength and high resistance to oxidation and corrosion at elevated temperatures and that consists essentially of 13.1–15.0% Cr, 8.5–10.5% Co, 1.0–3.5% Mo, 3.5–4.5% W, 3.0–5.5% Ta, 3.5–4.5% Al, 2.2–3.2% Ti, 0.06–0.12% C, 0.005–0.025% B, 0.010–0.05% Zr, 1–100 ppm of Mg and/or Ca, with the remainder being Ni and incidental impurities, all percentages being on a weight basis, wherein said Ta contributes to an improvement in the high temperature strength of the nickel alloy through γ' phase precipitation.

3. The rotating blade or stationary vane of a gas turbine according to claim 2, wherein the nickel alloy is selected from the group consisting of (a) 13.1 weight % Cr, 9.0 weight % Co, 2.1 weight % Mo, 4.0 weight % W, 3.3 weight % Ta, 4.0 weight % Al, 2.7 weight % Ti, 0.08 weight % C, 0.011 weight % B, 0.030 weight % Zr, 54 ppm Ca, 22 ppm Mg and the balance being Ni;

(b) 14.0 weight % Cr, 8.5 weight % Co, 1.0 weight % Mo, 3.5 weight % W, 5.4 weight % Ta, 3.5 weight % Al 2.3 weight % Ti, 0.10 weight % C, 0.009 weight % B, 0.050 weight % Zr, 98 ppm Mg and the balance being Ni;

(c) 14.1 weight % Cr, 9.9 weight % Co, 1.5 weight % Mo, 4.3 weight % W, 4.6 weight % Ta, 4.1 weight % Al, 2.8 weight % Ti, 0.08 weight % C, 0.014 weight % B, 0.037 weight % Zr, 31 ppm Mg and the balance being Ni;

(d) 13.8 weight % Cr, 10.2 weight % Co, 1.6 weight % Mo, 4.4 weight % W, 4.8 weight % Ta, 4.1 weight % Al, 2.6 weight % Ti, 0.09 weight % C, 0.011 weight % B, 0.022 weight % Zr, 12 ppm Ca, 5 ppm Mg and the balance being Ni;

(e) 13.9 weight % Cr, 9.9 weight % Co, 1.5 weight % Mo, 4.5 weight % W, 4.6 weight % Ta, 4.1 weight % Al, 2.6 weight % Ti, 0.06 weight % C, 0.025 weight % B, 0.034 weight % Zr, 18 ppm Ca, 50 ppm Mg and the balance being Ni; and (f) 14.0 weight % Cr, 10.0 weight % Co, 1.5 weight % Mo, 4.3 weight % W, 4.7 weight % Ta, 4.0 weight % Al, 2.7 weight % Ti, 0.09 weight % C, 0.015 weight % B, 0.02 weight % Zr, 10 ppm Mg and the balance being Ni.

4. In a rotating blade or stationary vane of a gas turbine, wherein the improvement comprises the rotating blade or stationary vane being made of a nickel alloy that has high strength and high resistance to oxidation and corrosion at elevated temperatures and that consists essentially of 13.1–15.0%, Cr, 8.5–10.5% Co, 1.0–3.5% Mo, 3.5–4.5% W, 3.0–5.5% Ta, 3.5–4.5% Al, 2.2–3.2% Ti, 0.06–0.12% C, 0.005–0.025% B, 0.010–0.05% Zr, 1–100 ppm of Mg and/or Ca and 0.5–1.5% Hf, with the remainder being Ni and incidental impurities, all percentages being on a weight basis, wherein said Ta contributes to an improvement in the high temperature strength of the nickel alloy through γ' phase precipitation.

5. The rotating blade or stationary vane of a gas turbine according to claim 4, wherein the nickel alloy is selected from the group consisting of (a) 15.0 weight % Cr, 10.1 weight % Co, 3.5 weight % Mo, 4.3 weight % W, 4.9 weight % Ta, 4.3 weight % Al, 3.2 weight % Ti, 0.06 weight % C, 0.007 weight % B, 0.041 weight % Zr, 5 ppm Ca, 1.1 weight % Hf and the balance being Ni;

(b) 13.5 weight % Cr, 10.5 weight % Co, 1.5 weight % Mo, 3.7 weight % W, 3.0 weight % Ta, 3.7 weight % Al, 2.5 weight % Ti, 0.12 weight % C, 0.015 weight % B, 0.034 weight % Zr, 25 ppm Ca, 37 ppm Mg, 0.7 weight % Hf and the balance being Ni;

(c) 13.9 weight % Cr, 10.3 weight % Co, 1.6 weight % Mo, 4.3 weight % W, 4.8 weight % Ta, 4.0 weight % Al, 2.7 weight % Ti, 0.08 weight % C, 0.009 weight % B, 0.013 weight % Zr, 80 ppm Mg, 0.3 weight % Hf and the balance being Ni; and (d) 14.2 weight % Cr, 9.6 weight % Co, 1.4 weight % Mo, 4.1 weight % W, 4.6 weight % Ta, 3.9 weight % Al, 2.7 weight % Ti, 0.10 weight % C, 0.013 weight % B, 0.023 weight % Zr, 28 ppm Ca, 29 ppm Mg, 0.2 weight % Hf and the balance being Ni.

6. In a rotating blade or stationary vane of a gas turbine, wherein the improvement comprises the rotating blade or stationary vane being made of a nickel alloy that has high strength and high resistance to oxidation and corrosion at elevated temperatures and that consists essentially of 13.1–15.0% Cr, 8.5–10.5% Co, 1.0–3.5% Mo, 3.5–4.5% W, 3.0–5.5% Ta, 3.5–4.5% Al, 2.2–3.2% Ti, 0.06–0.12% C, 0.005–0.025% B, 0.010–0.05% Zr, 1–100 ppm of Mg and/or Ca and 0–0.5% of at least one element selected from the group consisting of Pt, Rh and Re, with the remainder being Ni and incidental impurities, all percentages being on a weight basis, wherein said Ta contributes to an improvement in the high temperature strength of the nickel alloy through γ' phase precipitation.

7. In a rotating blade or stationary vane of a gas turbine, wherein the improvement comprises the rotating blade or stationary vane being made of a nickel alloy that has high strength and high resistance to oxidation and corrosion at elevated temperatures and that consists essentially of 13.1–15.0% Cr, 8.5–10.5% Co, 1.0–3.5% Mo, 3.5–4.5% W, 3.0–5.5% Ta, 3.5–4.5% Al, 2.2–3.2% Ti, 0.06–0.12% C, 0.005–0.025% B, 0.010–0.05% Zr, 1–100 ppm of Mg and/or Ca, 0.5–1.5% Hf and 0.05–0.5% of at least one element selected from the group consisting of Pt, Rh and Re, with the remainder being Ni and incidental impurities, all percentages being on a weight basis, wherein said Ta contributes to an improvement in one high temperature strength of the nickel alloy through γ' phase precipitation.

8. In a rotating blade or stationary vane of a gas turbine, wherein the improvement comprises the rotating blade or stationary vane being made of a nickel alloy that has high strength and high resistance to oxidation and corrosion at elevated temperatures and that consists essentially of 13.7–14.3% Cr, 9.5–10.5% Co, 1.3–1.7% Mo, 4.1–4.5% W, 4.5–4.9% Ta, 3.8–4.2% Al, 2.5–2.9% Ti, 0.06–0.12% C, 0.005–0.025% B, 0.010–0.05% Zr and 1–100 ppm of Mg and/or Ca, with the remainder being Ni and incidental impurities, all percentages being on a weight basis, wherein said Ta contributes to an improvement in the high temperature strength of the nickel alloy through γ' phase precipitation.

9. In a rotating blade or stationary vane of a gas turbine, wherein the improvement comprises the rotating blade or stationary vane being made of a nickel alloy that has high strength and high resistance to oxidation and corrosion at elevated temperatures and that consists essentially of 13.7–14.3% Cr, 9.5–10.5% Co, 1.3–1.7% Mo, 4.1–4.5% W, 4.5–4.9% Ta, 3.8–4.2% Al, 2.5–2.9% Ti, 0.06–0.12% C, 0.005–0.025% B, 0.010–0.05% Zr, 1–100 ppm of Mg and/or Ca, 0–1.5% Hf and 0–0.5% of at least one element selected from the group consisting of Pt, Rh and Re, with the remainder being Ni and incidental impurities, all percentages being on a weight basis, wherein said Ta contributes to an improvement in the high temperature strength of the nickel alloy through γ' phase precipitation.

10. In a rotating blade or stationary vane of a gas turbine, wherein the improvement comprises the rotating blade or stationary vane being made of a nickel alloy that has high strength and high resistance to oxidation and corrosion at elevated temperatures and that consists essentially of 14.0% Cr, 10.0% Co, 1.5% Mo, 4.3% W, 4.7% Ta, 4.0% Al, 2.7% Ti, 0.09% C, 0.015% B, 0.02% Zr and 10 ppm of Mg, with the remainder being Ni and incidental impurities, all percentages being on a weight basis, wherein said Ta contributes to an improvement in the high temperature strength of the nickel alloy through γ' phase precipitation.

11. In a rotating blade or stationary vane of a gas turbine, wherein the improvement comprises the rotating blade or stationary vane being made of a nickel alloy that has high strength and high resistance to oxidation and corrosion at elevated temperatures and that consists essentially of 13.1–15.0% Cr, 9.5–10.5% Co, 1.0–3.5% Mo, 3.5–4.5% W, 3.0–5.5% Ta, 3.5–4.5% Al, 2.2–3.2% Ti, 0.06–0.12% C, 0.005–0.025% B, 0.010–0.05% Zr, 1–100 ppm of Mg and/or Ca, 0.05–0.5% Rh, with the remainder being Ni and incidental impurities, all percentages being on a weight basis, wherein said Ta contributes to an improvement in the high temperature strength of the nickel alloy through γ' phase precipitation.

12. In a rotating blade or stationary vane of a gas turbine, wherein the improvement comprises the rotating blade or stationary vane being made of a nickel alloy that has high strength and high resistance to oxidation and corrosion at elevated temperatures and that consists essentially of 13.1–15.0% Cr, 8.5–10.5% Co, 1.0–3.5% Mo, 3.5–4.5% W, 3.0–5.5% Ta, 3.5–4.5% Al, 2.5–3.2% Ti, 0.06–0.12% C, 0.005–0.025% B, 0.010–0.05% Zr, 1–100 ppm of Mg and/or Ca, 0.5–1.5% Hf and 0.05–0.5% of Rh, with the remainder being Ni and incidental impurities, all percentages being on a weight basis, wherein said Ta contributes to an improvement in the high strength of the nickel alloy through γ' phase precipitation.

13. In a rotating stationary vane of a gas turbine, wherein the improvement comprises the rotating blade or stationary vane being made of a nickel alloy that has high strength and high resistance to oxidation and corrosion at elevated temperatures and that consists essentially of 13.7–14.3% Cr, 9.5–10.5% Co, 1.3–1.7% Mo, 4.1–4.5% W, 4.5–4.9% Ta, 3.8–4.2% Al, 2.5–2.9% Ti, 0.06–0.12% C, 0.005–0.025% B, 0.010–0.05% Zr, 1–100 ppm of Mg and/or Ca, 0–1.5% Hf and 0–0.5% of at least one element selected from the group consisting of Pt, Rh and Re, with the remainder being Ni and incidental impurities, all percentages being on a weight basis, wherein said Ta contributes to an improvement in the high strength of the nickel alloy through γ' phase precipitation.

14. The rotating blade or stationary vane of a gas turbine according to claim 13, wherein said Hf is in an amount of 0.5–1.5% and said at least one element selected from the group consisting of Pt, Rh and Re is in an amount of 0.05–0.5%.

15. In a rotating blade or stationary vane of a gas turbine, wherein the improvement comprises the rotating blade or stationary vane being made of a nickel alloy that has high strength and high resistance to oxidation and corrosion at elevated temperatures and that consists of 13.1–15.0% Cr, 8.5–10.5% Co, 1.0–3.5% Mo, 3.5–4.5% W, 3.0–5.5% Ta, 3.5–4.5% Al, 2.2–3.2% Ti, 0.06–0.12% C, 0.005–0.025% B, 0.010–0.05% Zr, 1–100 ppm of Mg and/or Ca, 0–1.5% Hf and 0.05–0.2% of Re, with the remainder being Ni and incidental impurities, all percentages being on a weight basis, wherein said Ta contributes to an improvement in the high temperature strength of the nickel alloy through γ' phase precipitation.

* * * * *